United States Patent [19]

Lee

[11] Patent Number: 4,997,392

[45] Date of Patent: Mar. 5, 1991

[54] WATERPROOF EXTERNAL CONNECTOR

[75] Inventor: Chee A. Lee, B'worth, Malaysia

[73] Assignee: Motorola, Inc., Schaumburg, Ill.

[21] Appl. No.: 431,808

[22] Filed: Nov. 6, 1989

[51] Int. Cl.[5] ..... H01R 13/52

[52] U.S. Cl. ..... 439/589; 174/52.3

[58] Field of Search ..... 439/76, 587, 588, 589; 174/52.3; 361/272

[56] References Cited

U.S. PATENT DOCUMENTS

| | | | |
|---|---|---|---|
| 2,383,926 | 8/1945 | White | 439/589 |
| 2,451,516 | 10/1948 | Skobel | 439/589 |
| 3,172,945 | 3/1965 | Wyman | 174/52.3 |
| 3,428,869 | 2/1969 | Gilbert | 174/52.3 |

*Primary Examiner*—Neil Abrams

*Attorney, Agent, or Firm*—Eugene A. Parsons; Daniel K. Nichols

[57] ABSTRACT

A connector frame and a resilient pad positioned against the frame, both having an equal number of coaxial openings therethrough. A pin positioned in each opening of the pad and extending through the pad and frame with a collar abutting the pad. A back-up plate having the same number of coaxially positioned openings therethrough and abutting the opposite sides of the collars of the pins so that the pad is compressed to make the connector waterproof and reduce tolerance stack-ups.

9 Claims, 2 Drawing Sheets

WATERPROOF EXTERNAL CONNECTOR

The present invention pertains to a waterproof external connector for portable communication devices and more specifically to waterproof external connectors which are simple and inexpensive to manufacture.

BACKGROUND OF THE INVENTION

In many applications it is necessary and/or convenient to provide external connectors on portable communications devices, such as portable radios and the like, for ready electrical access to the internal circuits. Because these portable communications devices are used under adverse weather conditions it is necessary to maintain the integrity of the housing. Thus the external connector must be waterproof.

In prior art connectors utilized for this purpose, solid connector pins are ultrasonically inserted into a plastic base which is then affixed over an opening in the housing of the communication device. The pins are expensive and complicated to manufacture and the connector is complicated to assemble and requires the use of special fixtures and machine set-ups. Thus, the prior art structures are expensive. Further, the pins of these prior art connectors are connected to the internal circuitry by a header and socket arrangement which is expensive and complicated.

SUMMARY OF THE INVENTION

It is an object of the present invention to provide a new and improved waterproof, external connector for portable communication devices and the like.

It is a further object of the present invention to provide a new and improved waterproof, external connector which is simpler and cheaper to manufacture and assemble.

It is a further object of the present invention to provide a new and improved method of constructing and assembling an external, waterproof connector for portable communication devices.

These and other objects are realized in a waterproof, external connector for portable communication devices including a connector frame formed with opposed surfaces and having a plurality of openings therethrough, a resilient waterproof pad positioned parallel and adjacent to one of the connector frame surfaces and having the same number of openings therethrough positioned coaxial with the openings through the connector frame, a plurality of elongated pins each having a first end extending into the openings of the pad and connector frame and each including a radially outwardly extending collar positioned in abutting engagement with the pad, and a back-up plate having the same number of openings therethrough positioned coaxially over a second end of the pins so that the pins extend through the plate and the collar of each pin is positioned in abutting engagement with the plate. A flexible circuit is soldered directly to the second end of the pins and connected to the internal circuits of the communication device.

BRIEF DESCRIPTION OF THE DRAWINGS

Referring to the drawings.

DESCRIPTION OF THE PREFERRED EMBODIMENTS

Figure 1:
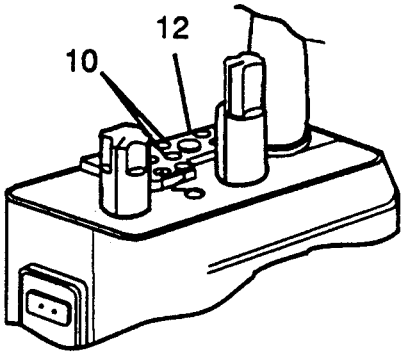
Fig. 1 (PRIOR ART)
FIG. 1 is a view in perspective of a portable communication device, portions thereof broken away, including a prior art external connector.

FIG. 1 illustrates in a perspective view a portable communications device, portions thereof broken away, with a prior art external waterproof connector. In this structure, a plurality of pins 10 are constructed with knurling and undercuts. The pins are then ultrasonically inserted into a mounting board 12 which, because of the construction of the pins and the type of insertion, produces a water tight seal. The mounting board 12 may be formed as an integral part of the upper surface of the device or may be fixedly attached thereto by some convenient means. A header and sockets are used internally to connect the pins to the circuits of the device.

Because of the knurling and undercuts required for water-sealing, pins 10 are expensive to manufacture. Also, a close relationship is required between the size of pins 10 and the hole diameters through mounting board 12, which adds to the cost and handling complexities. Further, the ultrasonic insertion of the pins requires expensive fixtures and equipment, and extensive set-up time. The header and sockets used for connection between the connector and the internal circuits are expensive and require additional internal space.

Figure 2:
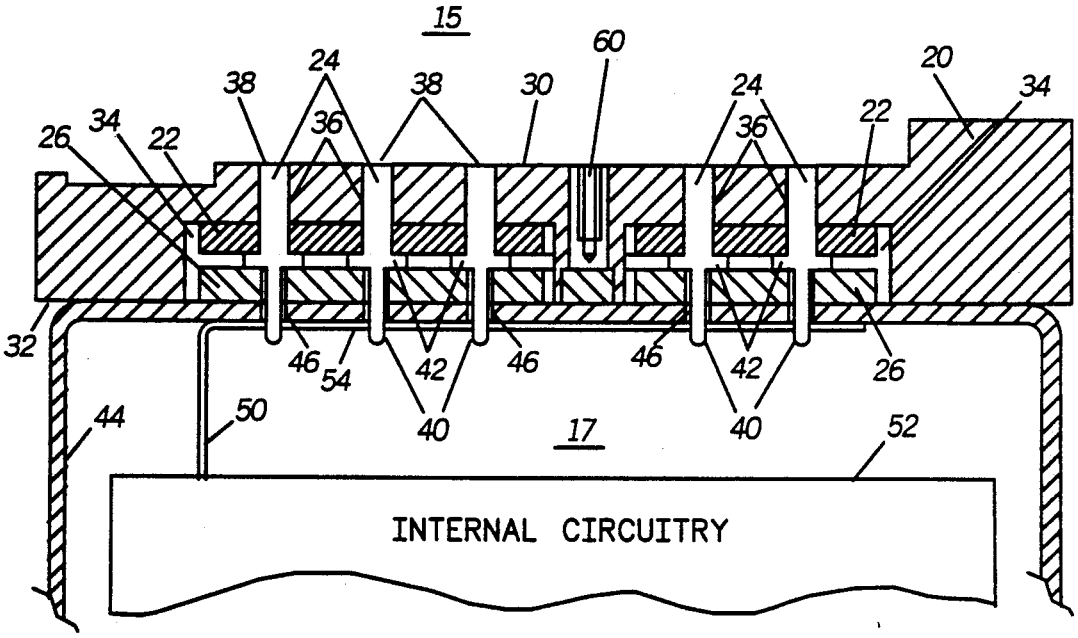
FIG. 2 is a sectional view of an external connector embodying the present invention and mounted on a portable communication device similar to that of FIG. 1.

Referring specifically to FIG. 2, a waterproof external connector 15 embodying the present invention and attached to a portable communication device 17, similar to that of FIG. 1, is illustrated in a sectional view. External connector 15 includes a connector frame 20, a resilient pad 22, a plurality of elongated pins 24 and a back-up plate 26. In this specific embodiment, connector frame 20 is constructed of a hard plastic material which is an electrical insulator, and is formed with first and second planar surfaces 30 and 32, respectively, positioned in parallel opposed relationship. Second planar surface 32 has a recess 34 formed therein and a plurality of openings 36 are formed in connector frame 20 so as to extend from first surface 30 into recess 34.

Resilient pad 22 is constructed to fit into recess 34 parallel with and against the surface of connector frame 20. Resilient pad 22 is constructed of an electrically insulating material, such as rubber or the like, and has a plurality of openings therethrough. The openings through resilient pad 22 are equal in number to openings 36 through connector frame 20 and, with resilient pad 22 properly positioned in recess 34, are coaxial therewith. It will of course be understood by those skilled in the art that while resilient pad 22 is shown in this embodiment as formed completely of the same resilient material, it could be constructed with a harder material forming the lower surface if desired for some applications.

Plurality of elongated pins 24 are each constructed of an electrical conductor formed in a solid piece, which may have any desired cross section, such as round, square, etc. Each pin 24 has an external surface 38 (the upper surface in FIG. 2), an internal surface 40 (the lower end in FIG. 2) and a radially outwardly extending collar 42. Elongated pins 24 are positioned, one each, in the openings in resilient pad 22 so as to extend through openings 36 in connector frame 20 with external surface 38 generally in the plane of surface 30 when connector 15 is properly assembled. Also, the upper surface of collar 42 on each of the elongated pins 24 is in abutting engagement with the lower surface of resilient pad 22.

Back-up plate 26 is constructed of a hard electrically insulating plastic material formed to fit within recess 34 in connector frame 20. Back-up plate 26 has a plurality of openings therethrough equal in number to openings 36 through connector frame 20 and coaxial therewith when back-up plate 26 is properly positioned in recess 34. Back-up plate 34 fits over elongated pins 24 with the internal (to recess 34) surface thereof abutting collars 42 of elongated pins 24 and internal surfaces 40 of elongated pins 24 extending outwardly from the external surface of back-up plate 26. In this embodiment, recess 34, resilient pad 22, elongated pins 24 and back-up plate 26 are constructed so that external surfaces 38 of elongated pins 24 are approximately in the plane of first surface 30 of connector frame 20 when the external surface of back-up plate 26 is in the plane of second surface 32 of connector frame 20. Resilient pad 22 acts as a cushion to compensate for tolerance stack-ups in the assembly of connector 15. Also, resilient pad 22 should be compressed slightly to engage adjacent surfaces of connector frame 20 and elongated pins 24 and effectively render connector 20 waterproof.

Connector 15 is affixed to an outer surface of a housing 44 of portable communication device 17 by any convenient means. For example, connector frame 20 can be formed at least partially of metal and soldered or welded to housing 44. Connector frame 20 can be affixed to the outer surface of housing 44 by screws, bolts, glue, etc. and a thin layer of waterproof epoxy or the like can be provided therebetween to maintain the waterproof integrity. In some applications it may be desirable to form connector frame 20 as an integral part of housing 44 and provide electrically insulating inserts surrounding elongated pins 24, if housing 44 is constructed of metal.

In the embodiment illustrated in FIG. 2, internal surfaces 40 of elongated pins 24 each extend through holes 46 in housing 44 and into the central opening thereof. A flexible circuit 50, including a plurality of connecting leads, is positioned with one end in engagement with elongated pins 24 and the other end connected to internal circuitry 52 (illustrated as a single box for simplicity). Each lead at the one end of flexible circuit 50 is fixedly attached to an appropriate elongated pin 24 by some convenient means, such as soldering. Thus, the expensive header and sockets is eliminated. Flexible circuit 50 may be additionally supported by a thin piece of stiffening material 54 if desired. Thus, external surfaces 38 of elongated pins 24 provide contacts for electrical access to internal circuitry 52 in portable communication device 17.

The assembly of connector 15 is accomplished by inserting exterior surfaces 38 of pins 24 through the openings in resilient pad 22. In this specific embodiment there are a total of thirteen pins positioned in a group of nine (3×3) and a group of four (2×2) separated by a screw hole 60, provided for receiving a mounting screw to affix a remote unit mating connector to connector 15. The openings through resilient pad 22 should be slightly smaller than a cross section of elongated pins 24 so that, once inserted, the pins remain engaged in the openings. Resilient pad 22 is then dropped into recess 34 so that exterior surfaces 38 of elongated pins 24 are positioned in openings 36 of connector frame 20. Back-up plate 26 is then positioned over interior surfaces 40 of elongated pins 24 and connector frame 20 is tightly engaged onto the outer surface of housing 44. Flexible circuit 50 is positioned over interior surfaces 40 of elongated pins 24 and stiffening material 54 is added, if desired. Flexible circuit 50 is then soldered to interior surface 40 of each elongated pin 24.

Figure 3:
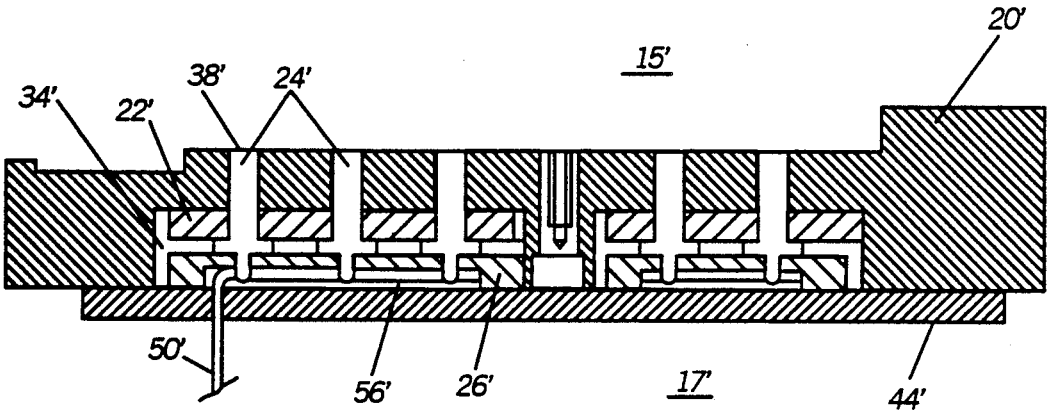
FIG. 3 is a sectional view similar to FIG. 2 of another embodiment.

A slightly different embodiment of the external connector is illustrated in FIG. 3. This figure is similar to FIG. 2 and like parts are designated with like numbers having a prime added to indicate the different embodiment. In this embodiment, as in the embodiment of FIG. 2, a recess 34′ is formed in connector frame 20′ and a resilient pad 22′ is positioned therein. A plurality of elongated pins 24′ are positioned in openings therethrough and a back-up plate 26′ is fitted thereover. Resilient pad 22′ allows for tolerance stack-ups during assembly and provides waterproofing of connector 15′. The difference in this embodiment is that back-up plate 26′ is provided with a shallow recess 56′ in the external surface (bottom surface in FIG. 3) thereof. Also, elongated pins 24′ are shortened so they extend only into recess 56′ and not to the outer surface of housing 44′. Flexible circuit 50′ extends through a single opening in housing 44′ and is connected to elongated pins 24′ in recess 56′ as explained in conjunction with FIG. 2. This embodiment can provide some additional integrity of housing 44′ if required, but may be slightly more difficult to assemble since back-up plate 26′ must be fixed in the proper position in recess 34′ before attachment of flexible circuit 50′ is completed.

Thus, an improved waterproof external connector for portable communication devices and an improved method for assembling one embodiment thereof is disclosed. The improved connector utilizes much simpler components, which reduces complicated manufacturing procedures and cost of the components. Further, complex set-up and assembly procedures are eliminated to reduce and simplify assembly. Also, the present connector compensates for tolerance stack-ups during assembly so that out-of-tolerance rejects are less likely to occur.

While I have shown and described specific embodiments of the present invention, further modifications and improvements will occur to those skilled in the art. I desire it to be understood, therefore, that this invention is not limited to the particular forms shown and I intend in the appended claims to cover all modifications that do not depart from the spirit and scope of this invention.

What is claimed is:

1. A waterproof, external connector for a portable communication device comprising:

a connector frame having first and second surfaces positioned in opposed relationship and a plurality of openings extending therethrough from the first surface to the second surface;

a plurality of miniature elongated pins having an external contact surface at one end, an internal contact surface adjacent another end and a radially outwardly extending collar therebetween;

a pad constructed at least partially of resilient, waterproof material having a plurality of openings therethrough of equal number with the plurality of openings in said connector frame and positioned so that the openings through said pad are coaxial with the openings through said connector frame, one of said plurality of pins being positioned in each of the openings through said pad so as to extend through the openings in said connector frame with the external contact surface being accessible at the first surface of said connector frame and the collar of each of said plurality of pins abutting a surface of said pad;

a back-up plate having a plurality of openings therethrough of equal number and coaxial with the openings through said pad and positioned with the collars of said plurality of pins abutting an internal surface of said plate and the internal contact surfaces of said plurality of pins being accessible at an external surface of said plate;

said connector frame being constructed for attachment to an outer surface of a portable communication device with the second surface of said connector frame being positioned generally parallel and adjacent to the outer surface of the portable communication device; and means for connecting the internal contact surfaces of said plurality of pins to internal circuitry of the portable communication device;

the connector frame including a recess formed in the second surface with the openings extending from the first surface into the recess and the pad and back-up plate are positioned in said recess.

2. A waterproof, external connector providing external access to a portable communication device comprising:

a portable communication device including a housing having an outer surface and internal circuitry contained within the housing;

a connector frame having first and second planar surfaces positioned in opposed relationship with a recess formed in the second planar surface and a plurality of openings extending from the first planar surface into the recess in the second planar surface;

a plurality of miniature elongated pins each having an external contact surface at one end, an internal contact surface adjacent another end and a radially outwardly extending collar therebetween;

a pad constructed at least partially of resilient, waterproof material fitted in the recess in said connector frame and having a plurality of openings therethrough of equal number and coaxial with the plurality of openings in said connector frame, one of said plurality of pins being positioned in each of the openings of said pad so as to extend through the openings in said connector frame with the external contact surface being accessible at the first planar surface of said connector frame and the collar of each of said pins abutting a surface of said pad;

a back-up plate having a plurality of openings therethrough of equal number and coaxial with the openings through said pad and positioned in the recess of said connector frame with the collars of said plurality of pins abutting an internal surface of said plate and the internal contact surfaces of said plurality of pins extending beyond an external surface of said plate;

said connector frame being attached to the outer surface of said portable communication device with the second planar surface of said connector frame being positioned generally parallel and adjacent to the outer surface of said portable communication device; and means electrically connecting the internal contact surfaces of said plurality of pins to internal circuitry of said portable communication device.

3. A waterproof, external connector as claimed in claim 2 wherein the plurality of miniature elongated pins are insulated from the connector frame, the pad, the back-up plate and the outer surface of the portable communication device.

4. A waterproof, external connector as claimed in claim 3 wherein the pad is constructed at least partially of rubber and the connector frame and back-up plate are constructed of electrically insulating plastic material.

5. A waterproof, external connector as claimed in claim 2 including in addition at least one opening through the outer surface of the communication device through which the pins and connecting means are connected.

6. A waterproof, external connector as claimed in claim 2 wherein the means connected to the internal contact surfaces includes a flexible wiring circuit.

7. A waterproof, external connector as claimed in claim 6 wherein the flexible wiring circuit is attached to the internal contact surfaces of the plurality of pins by soldering.

8. A waterproof, external connector as claimed in claim 2 wherein the back-up plate is constructed to abut the collars of the plurality of pins and compress the pad to prevent moisture from entering the plurality of openings in the connector frame.

9. An improved method of constructing a waterproof, external connector for a portable communication device comprising the steps of:

providing a portable communication device with a housing having a plurality of openings therethrough and a surface with means for attaching an external, waterproof connector thereto;

providing a connector frame having first and second surfaces with a recess formed in the second surface and a plurality of openings extending from the first surface to the second surface, a plurality of pins each having an external contact surface at one end, an internal contact surface adjacent another end and a radially outwardly extending collar therebetween, a resilient pad and back-up plate each formed to fit into the recess and having a like plurality of openings therethrough coaxial with the openings through the frame, and a flexible circuit having a plurality of leads formed to engage the internal contact surface of each of the pins;

inserting the external contact surface of each pin through an opening in the resilient pad;

positioning the pad and pins in the recess of the connector frame so the external surfaces of the pins are extended into the openings through the connector frame;

positioning the back-up plate in the recess of the connector frame so the internal surfaces of the pins extend through the openings in the back-up plate and the pin collars abut the back-up plate;

positioning the second surface of the connector frame against the outer surface of the housing of the portable communications device with the internal surfaces of the pins extending through the openings in the housing;

attaching the connector frame tightly to the housing to force the back-up plate into the recess of the connector frame and compress the resilient pad to waterproof the external connector;

positioning the flexible circuit in engagement with the internal surfaces of the pins within the housing of the portable communication device; and soldering the flexible circuit to the internal surfaces of the pins within the housing of the portable communication device.

* * * * *